United States Patent [19]

Laurence, deceased et al.

[11] Patent Number: 4,996,712

[45] Date of Patent: Feb. 26, 1991

[54] HEARING AIDS

[75] Inventors: Roger F. Laurence, deceased, late of Camberley; Leon R. Morgan, executor, London, both of England

[73] Assignee: National Research Development Corporation, London, England

[21] Appl. No.: 465,523

[22] Filed: Jan. 17, 1990

Related U.S. Application Data

[63] Continuation of Ser. No. 72,475, Jul. 13, 1987, abandoned.

[30] Foreign Application Priority Data

Jul. 11, 1986 [GB] United Kingdom ..... 8616959

[51] Int. Cl.[5] ..... H04R 25/00

[52] U.S. Cl. ..... 381/68.4; 381/107

[58] Field of Search ..... 381/68.4, 68, 94, 104, 381/106, 107, 108, 68.2

[56] References Cited

U.S. PATENT DOCUMENTS

| | | | |
|---|---|---|---|
| 3,571,529 | 3/1971 | Gharib et al. | 381/68 |
| 3,894,195 | 7/1975 | Kryter | 381/68.4 |
| 3,920,931 | 11/1975 | Yanick, Jr. | 381/68.4 |
| 3,989,904 | 11/1976 | Rohrer et al. | 381/68.4 |
| 4,099,035 | 7/1978 | Yanick | 381/94 |
| 4,289,935 | 9/1981 | Zollner et al. | 381/68.3 |
| 4,405,831 | 9/1983 | Michelson | 381/68.4 |
| 4,517,415 | 5/1985 | Laurence | 381/68.2 |
| 4,531,229 | 7/1985 | Coulter | 381/68 |
| 4,593,696 | 6/1986 | Hochmair et al. | 381/68 |
| 4,630,302 | 12/1986 | Kryter | 381/94 |

FOREIGN PATENT DOCUMENTS

| | | |
|---|---|---|
| WO85/02085 | 5/1985 | European Pat. Off. . |
| 0077688 | 7/1985 | European Pat. Off. . |
| 1506295 | 4/1978 | United Kingdom . |
| 2091065 | 7/1982 | United Kingdom . |
| 2108805 | 5/1983 | United Kingdom . |

OTHER PUBLICATIONS

Telex Communication, Inc., Preliminary Technical Data Specification Sheet 4216, Oct. 1983.

Telex Communications, Inc., Preliminary Technical Data Specification Sheet 4216-1, Nov. 1984, 4 pages.

D. Van Dalsen, "Need an Active Filter? Try These Design Aids", Electric Design News, vol. 23, No. 20, Nov. 1978, pp. 105-109.

M. Quere, "Les Filtres Elliptiques", Toute L'Electronique, Oct. 1977, pp. 55-64, Paris, France.

*Primary Examiner*—Forester W. Isen

*Attorney, Agent, or Firm*—Cushman, Darby & Cushman

[57] ABSTRACT

A hearing aid comprising an automatic gain control arrangement which provides an output signal of substantially constant average level. The automatic gain control arrangement has a slow control generator which provides a relatively slow release time and adapts the gain to the average level of the input signal, and a fast generator which provides a relatively fast release time to allow impulsive sounds or transient signals to be accommodated. When a sufficiently loud impulsive sound is received, the fast generator takes control of the gain to avoid discomfort or overloading. The automatic gain control arrangement limits the dynamic range for sound pressure levels above a threshold, such as 60 dB SPL.

21 Claims, 8 Drawing Sheets

46552

8

HEARING AIDS

This is a continuation of application Ser. No. 07/072,475, filed July 13, 1987, now abandoned.

BACKGROUND OF THE INVENTION (a) Field of the Invention

The present invention relates to hearing aids, and more particularly, to a hearing aid for delivering acoustic signals of a substantially constant average signal level to persons with moderate to severe hearing loss.

Hearing aids are apparatuses, normally electronic, for amplifying sound and supplying it to the ear of a person whose hearing is impaired. A microphone or other transducer converts sounds, particularly speech, or other signals into an electrical signal which is then amplified and supplied to an earphone inserted in the outer ear of the patient.

It is very common for a hearing impaired person to find that a hearing aid helps him to understand speech from one person in a quiet room but is useless if others are talking at the same time. The reason for this is that a patient who has reduced sensitivity of hearing, perhaps due to sensori neural deafness, usually has other deficiencies as well which are not normally measured.

The parameters important for speech understanding, particularly in noise, include:

Sensitivity: if the average hearing loss at 500, 1000 and 2000 Hz is less than 35 dB a patient can manage well unaided in quiet situations. If the loss is greater, he will benefit from amplification of the weaker speech components;

Recruitment: this is common, particularly with sensori neural deafness, which accounts for 80% of all deafness. The threshold of hearing is elevated. Below it the patient hears nothing. Above it the patient hears with the intensity of a normal ear so that sounds are either inaudible or loud;

Frequency discrimination: a healthy ear can detect a 1% change in frequency of a tone. A bad ear may only detect a 20% change, or even hear noise rather than a tone;

Frequency selectivity: the peripheral auditory system analyzes the incoming complex sounds of speech into their component frequencies by what are called auditory filters. If the ability to do this is impaired, speech recognition, particularly in noise, becomes very difficult. Understanding speech depends on comparing moment to moment changes in the spectrum of the speech sound;

Temporal discrimination: normal ears can perceive gaps in speech as small as 3 mS. Impaired ears may not perceive gaps of 10 mS. For speech recognition small gaps must be recognised. Noise makes matters worse by filling in the gaps; and Temporal masking: if a weak sound follows after a loud sound it may not be heard. This effect is often worse with impaired ears and causes weak consonants after loud vowels to be lost. Noise makes matters worse by masking weak consonants even further.

Not all these difficulties may be present in any particular patient, but a patient with an audiogram showing reduced sensitivity often has deficiences in some of these parameters as well.

A peculiarity of speech is that the vowels are loud and of low frequency and consonants are weak and of high frequency. Another peculiarity of speech is that most of the information is in the consonants.

FIG. 1 of the accompanying drawings, which is a graph of sound level against frequency, shows the threshold of hearing (THL) and the threshold of discomfort of a sensori-neural deaf patient. The threshold of discomfort is the same as for normal hearing whereas the threshold of hearing is raised compared with a normal THL. The temporal and frequency parameters which are needed to perceive speech tend to be better above an area which is labelled area of distortion, so that speech should be presented to the patient in the area above the area of distortion.

FIG. 2 of the accompanying drawings, which is a graph of sound level against frequency, shows the long term spectral distribution of ordinary quiet speech as the area between chain dotted lines to ensure that all components are heard by the patient, the speech envelope should be processed so that it fits between the broken lines. This means that high frequencies should be amplified more than low frequencies and that the dynamic range, particularly at high frequencies, should be reduced. Low frequencies must be prevented from becoming too loud or they will mask high frequencies.

(b) Description of the Prior Art

One previous but unsuccessful way of trying to achieve this is to provide a tone control to make the amplification greater at high frequencies, and then use automatic volume control (AVC) to reduce the dynamic range. This does not work because all the energy in speech is in the low pitched vowels and most of the information is in the weak high pitched consonants. AVC causes amplifier gain to drop when a loud vowel occurs so that a following weak consonant is suppressed and is not heard.

FIG. 3 of the accompanying drawings is a block circuit diagram of another known hearing aid of the type disclosed in EP 0077688. Signals from a microphone A1 are supplied to another amplifier A2. The amplifier A2 has conventional AVC which only operates at high speech levels above 70 dB SPL and is used to prevent very loud speech from overloading the system. The attack and release time constants are 2 milliseconds (mS) and 300 mS, respectively. The speech signal is then split into an upper frequency band above 1500 Hz and a lower band below 1500 Hz by high pass and low pass filters A3 and A4, respectively. The degree of compression needed by the patient is set in amplifier A5 for high frequencies to suit his dynamic range. Low frequency vowels do not go through this channel. The amplifier A5 limits the dynamic range of the signals with attack and release time constants of 2 mS and 10 mS, respectively. Similarly, the appropriate compression is set in a limiting amplifier A6 for low frequencies having attack and release time constants of 2 mS and 30 mS, respectively. More compression than necessary is used here so that loud sounds do not mask high frequencies. A mixer A7 combines the outputs of the amplifiers A5 and A6 and supplied the combined signal to a power amplifier A8 whose gain is adjusted to suit the threshold of discomfort of the patient. A receiver or earphone A9 delivers speech to the patient's ear.

In such a hearing aid, the amplifier A2 starts compressing or limiting at a fairly high threshold. Also, a relatively simple AVC system is used with attack and release time constants which are a compromise between conflicting requirements. Namely, first of all the input AGC amplifier should present all speech signals to the rest of the hearing aid at the same average level. Otherwise, the high frequency AGC channel will recover between speech peaks when high intensity speech is presented to the microphone and the hearing aid will sound noisy. Secondly the input AVC amplifier should extract the true average value of the incoming speech. The hearing aid shown in FIG. 3 uses input AVC with an attack time of 2 mS, so that the patient is protected against loud noises like a bang of a door, and a 300 mS release time to 90% of full sensitivity. To extract a real average, the release time should be much longer, for instance about 5 S, but then the bang of a door would disable the aid for an obtrusive time.

SUMMARY OF THE INVENTION

According to the invention, there is provided a hearing aid comprising: automatic gain control means for compressing the dynamic range of an input signal so as to provide an output signal of substantially constant average signal level in response to input signal levels within a predetermined range, the automatic gain control means comprising first and second gain control means for controlling gain in response to the input signal, the first gain control means having a first release time and the second gain control means having a second release time, the first release time being longer than the second release time; a plurality of signal processing channels for providing processed output signals, each of the signal processing channels receiving the output signal from the automatic gain control means and including frequency dependent filtering means; and means for providing a combined output signal from the processed output signals and for supplying the combined output signal to an output transducer.

By providing two gain control means with different release times, it is possible to control the gain automatically so as to accommodate two different input signals. The first gain control means with the longer release time can be used to provide gain control in response to the average input signal level, whereas the second gain control means with the shorter release time allows the gain to be reduced in response to transient or impulsive signals without suppressing following lower level signals. For this purpose, the release time of the first gain control means may be greater than 500 mS, preferably greater than or substantially equal to one second, for instance substantially equal to two seconds or even five seconds. The release time of the second gain control means is preferably less than 100 mS. For instance, it may be less than 75 mS to such as 50 mS.

Preferably, the attack time of the first gain control means is greater than the attack time of the second gain control means. The attack time of the first gain control means may be less than 100 mS, for instance substantially equal to 50 mS. Preferably, the attack time of the second gain control means is less than 10 mS, for instance substantially equal to 2 mS. The lower limit of the predetermined range may correspond to a sound pressure level of 55 or 60 dB. The upper limit may be 100 dB.

The plurality of signal processing channels may include a first channel comprising a low pass filter for passing a lowest frequency range and presettable gain control means. The or each of the other signal processing channels may include means for compressing or limiting dynamic range.

The hearing aid may include an equalizer for compensating ear canal resonance and/or output transducer frequency response. When an ear canal is occluded with an ear mould containing an ear piece, a standing wave is created which reduces sound pressures above 3 kHz progressively until a reduction of about 10 dB is reached at 4 kHz. Also, the earphone is normally driven by a voltage source in the form of a low output impedance amplifier to which it presents an inductive load. This results in a 6 dB/octave reduction in drive current through the earphone and hence in output level. The equalizer may be used to compensate for either or both of these phenomena. The automatic gain control means may comprise first and second gain control means for reducing gain in response to the level of the input signal, the first gain control means having a longer release time than the second gain control means.

The automatic gain control means may include a single variable gain element which is controlled by the first and second gain control means. Preferably, gate means are provided between the variable gain element and the first and second gain control means so as to pass the signal from the first and second gain control means which provides lower gain. Preferably, the first and second gain control means are arranged to reduce the gain of the amplifier when the level of the input signal exceeds first and second thresholds, respectively, the first threshold being lower than the second threshold. Thus, the gain of the amplifier is normally determined by the average level of the input signal. However, when a peak or transient signal of substantially higher level is received, the amplifier gain is reduced temporarily so as to avoid overloading or discomfort without suppressing or masking the signal following the transient or peak.

BRIEF DESCRIPTION OF THE DRAWINGS

The invention will be further described, by way of example, with reference to FIGS. 1 to 9 of the accompanying drawings, in which.

DESCRIPTION OF THE PREFERRED EMBODIMENT

Figure 4:
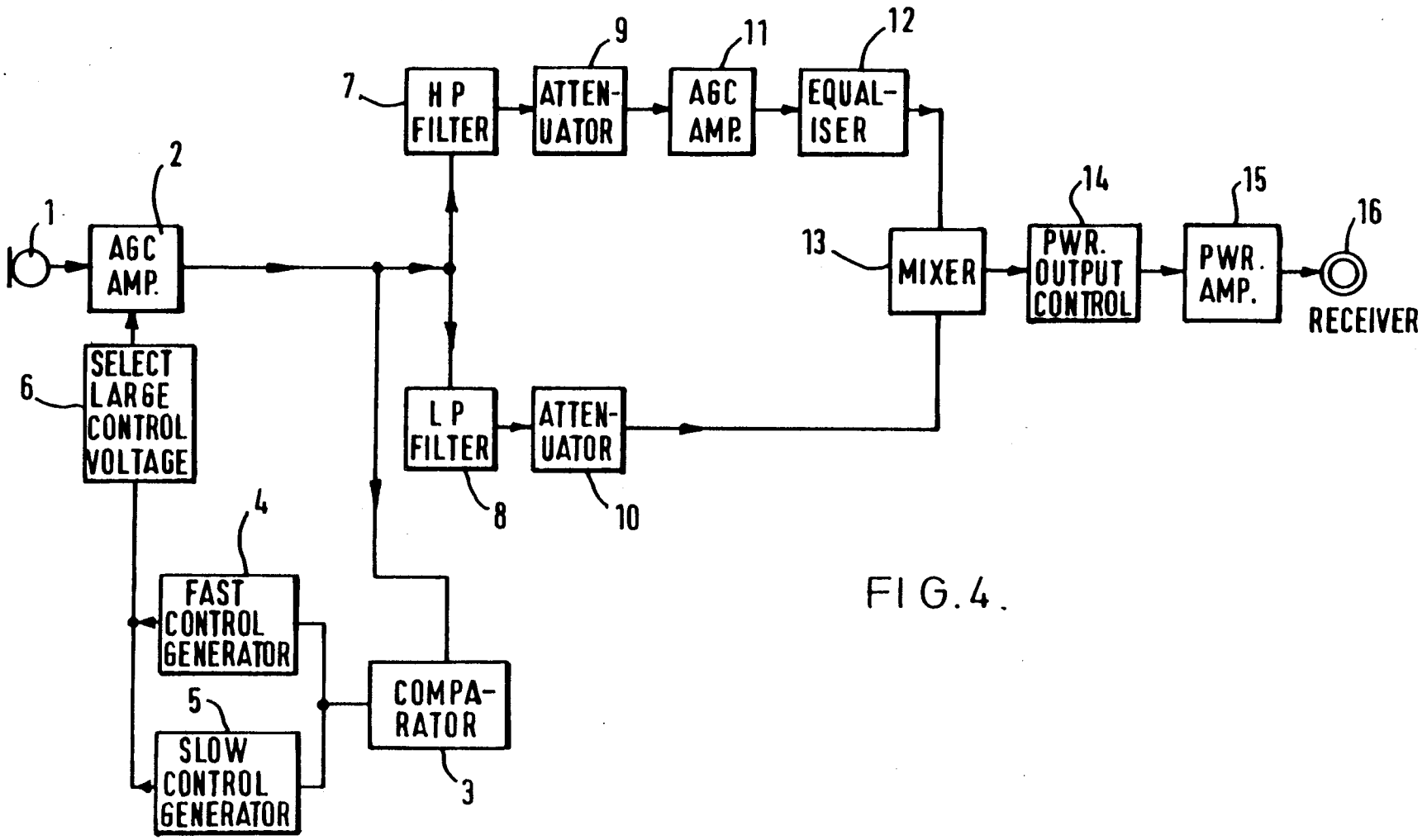
FIG. 4 is a block circuit diagram of a hearing aid constituting a first embodiment of the invention.

The hearing aid shown in FIG. 4 comprises a microphone 1 whose output is connected to the input of a gain controlled or AGC amplifier 2. The output of the amplifier 2 is supplied to a comparator 3 which compares the signals from the amplifier 2 and supplies an output corresponding to the amount by which the input signal exceeds a predetermined level, in particular a sound pressure level of 60 dB. The output of the comparator is supplied to a fast control generator 4 and a slow control generator 5, whose outputs are connected to a circuit 6 for selecting the larger of the control voltages from the generators 4 and 5. The output of the circuit 6 is supplied to a gain controlled input of the amplifier 2 so as to provide an automatic gain control function.

The fast control generator 4 has an attack time of 2 mS and a release time of 50 mS so as to protect a patient against initial loud speech syllables or loud transients, such as the banging of a door. The slow generator 5 has an attack time of 50 mS and a long release time, such as five seconds. The slow generator 5 thus extracts the average value of an input speech signal. The circuit 6 passes the larger of the signals from the generators 4 and 5 so that, in the absence of transient or impulsive sounds, the gain of the amplifier 2 is controlled by the average signal level but, when a relatively large transient sound occurs, the gain of the amplifier 2 is reduced quickly and recovers quickly.

The output of the amplifier 2 is also supplied to a high pass filter 7 and a low pass filter 8 provided in high pass and low pass channels, respectively. In the high pass channel, the output of the filter 7 is supplied to an adjustable attenuator 9 whose output is connected to the input of an automatic gain control amplifier 11 for compressing or limiting the dynamic range of the signals passing through the high pass channel. The output of the amplifier 11 is supplied to an equalizer 12 which compensates for sound pressure reduction above 3 kHz caused by standing waves in the ear canal when occluded by an ear mould containing an earphone. The equalizer 12 may also be arranged to compensate for the frequency response of the output transducer, which is normally of the inductive type, and supplied by a low output output impedance amplifier.

The output of the low pass filter 8 is connected to the input of an adjustable attenuator 10.

The outputs of the equalizer 12 and the attenuator 10 are mixed or summed in a mixer 13. The output of the mixer is supplied to a power output control 14, whose output is connected to a power amplifier 15. The output of the power amplifier 15 drives a receiver shown as an earphone 16.

Figure 1:
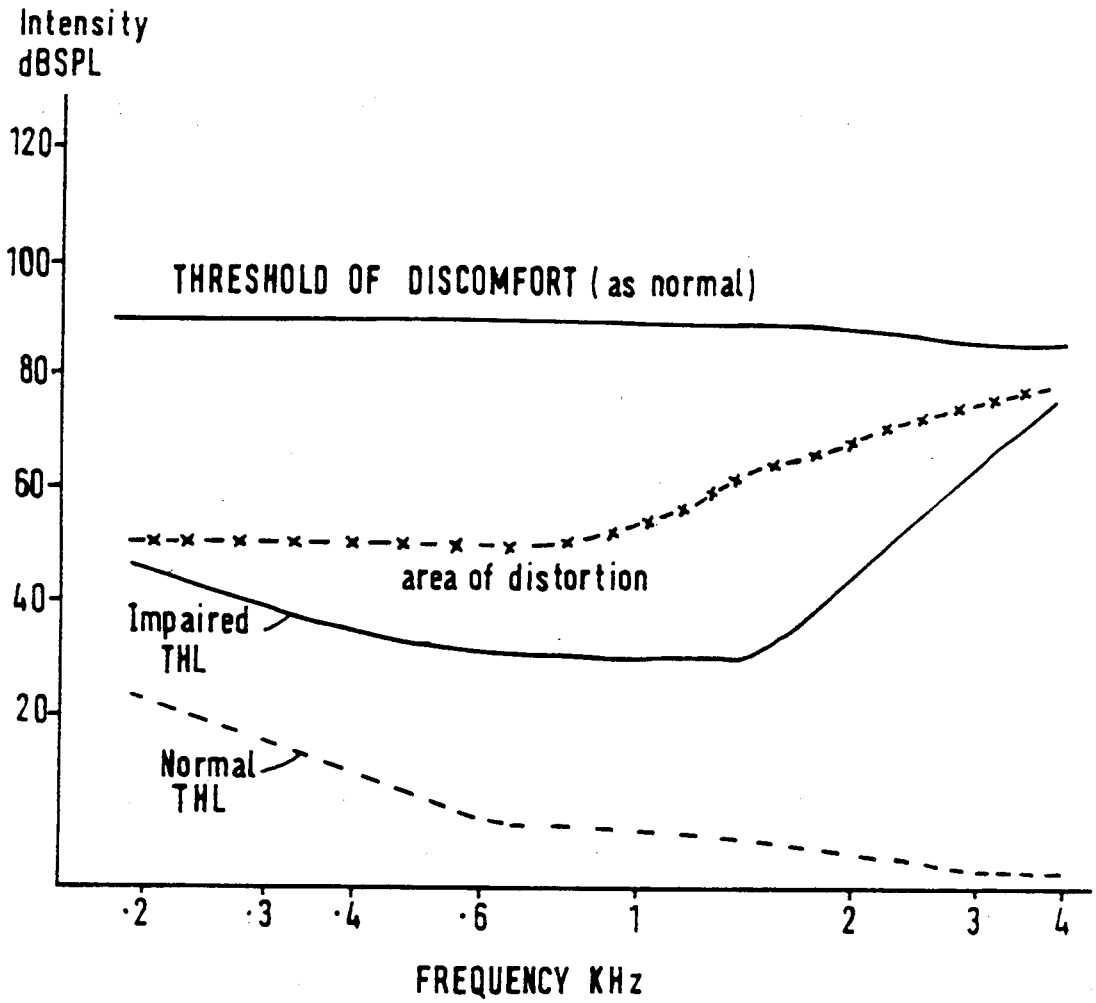
FIG. 1 is a graph of sound level against frequency showing the threshold of hearing and the threshold of discomfort of a sensori-neural deaf patient.
Figure 2:
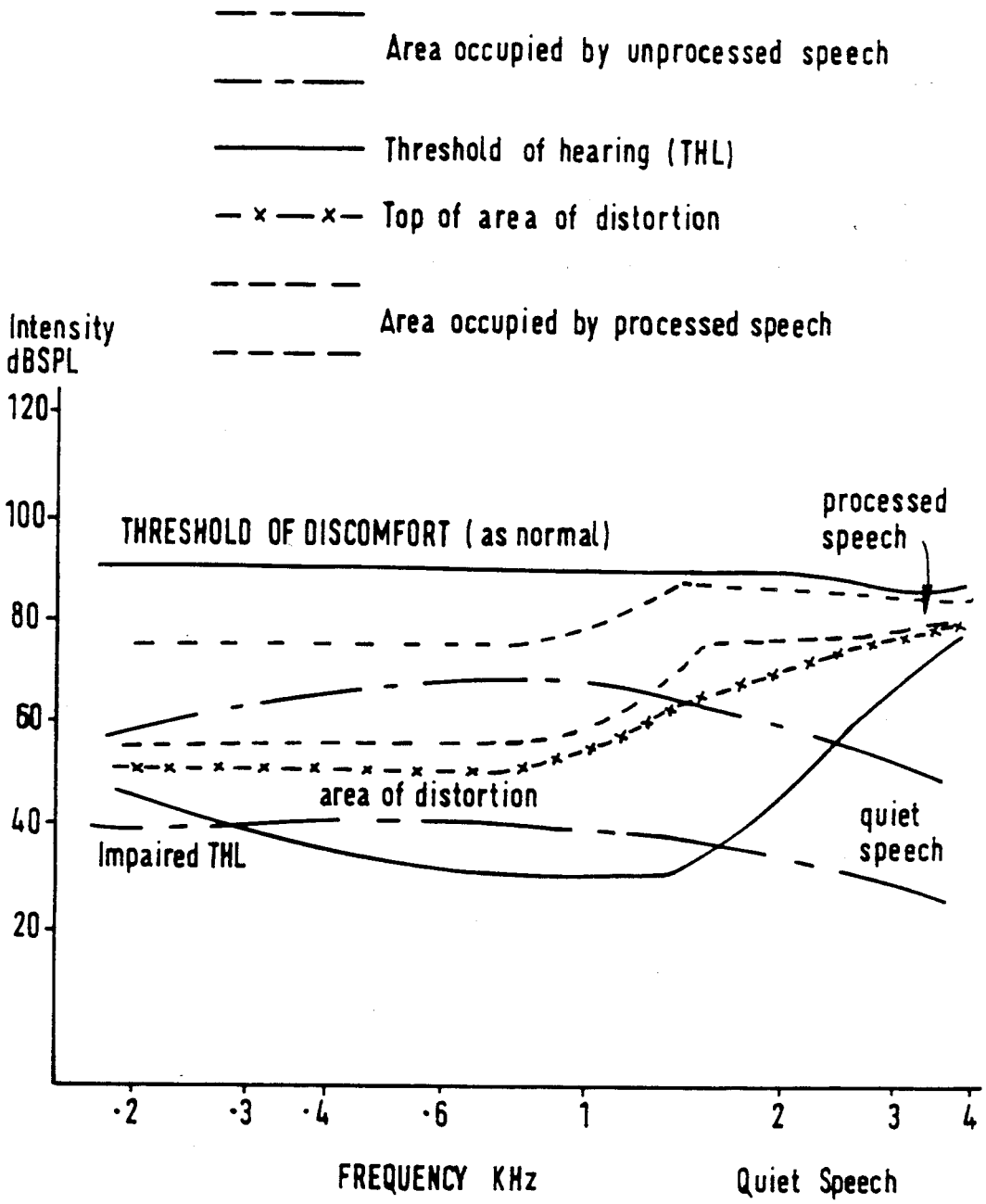
FIG. 2 is a graph of sound level against frequency showing the long term spectral distribution of ordinary quiet speech.
Figure 3:
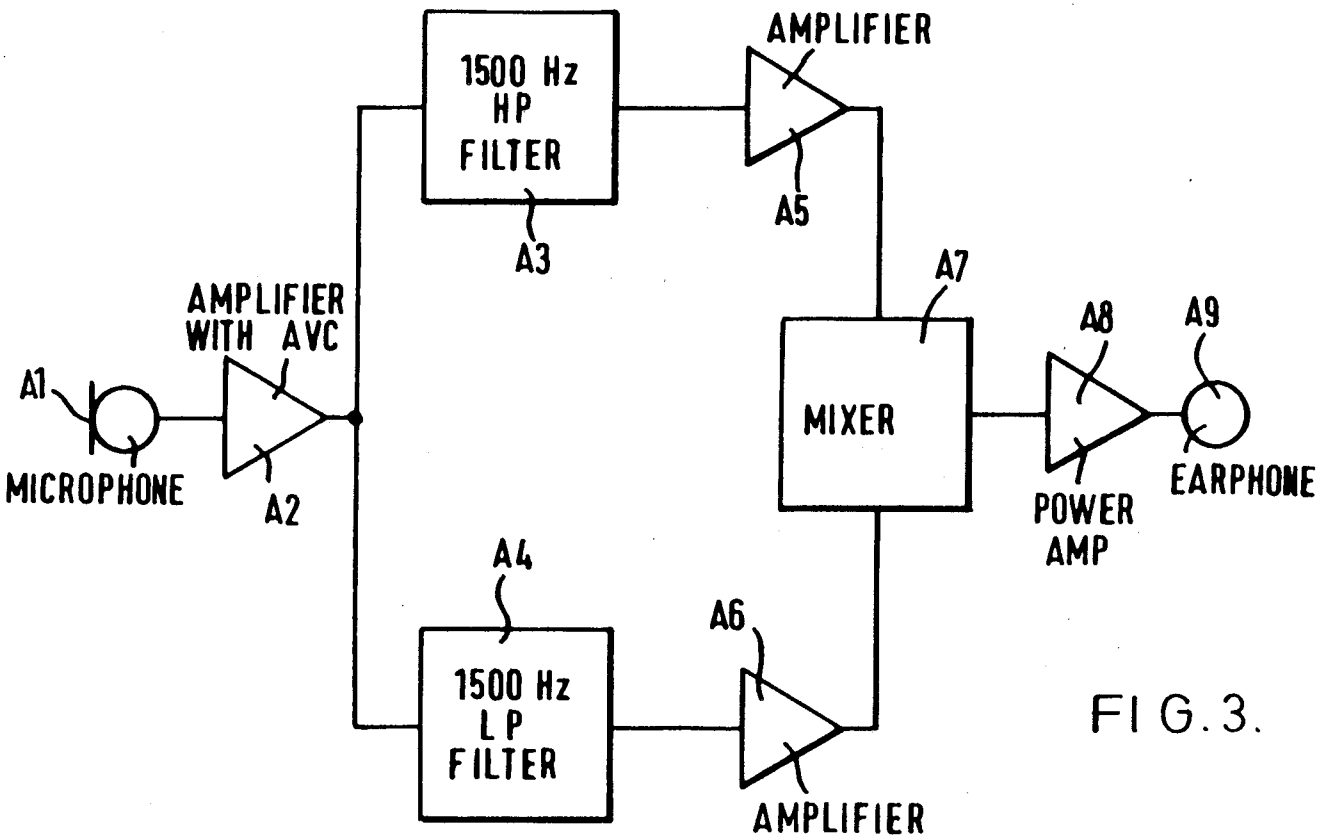
FIG. 3 is a block circuit diagram of a hearing aid of the prior art.

The automatic gain control circuit 2-6 compresses the dynamic range of signals whose amplitudes exceed 60 dB SPL so as to perform a limiting function in order to supply signals of substantially constant average level to the filters 7 and 8. Relatively high frequency signals, for instance above 1500 Hz, are supplied to the high pass channel whereas relatively low frequency signals are supplied to the low pass channel. The high pass channel thus processes signals which are principally generated by consonants and the dynamic range compression and amplification allows the level of the consonants to be boosted so as to lie in the area between the broken lines in FIG. 2. It is thus possible for consonant signals to be placed between the threshold of discomfort and the area of distortion so as to maximize the audibility of consonants and hence improve the intelligibility of speech.

The low pass channel processes signals which are predominantly associated with vowels. As is apparent from the curve defining the impaired threshold of hearing in FIG. 2, the dynamic range of a patient's hearing at relatively low frequencies is not too greatly reduced and, in many cases, it is not therefore necessary to provide any dynamic range compression at the lower frequencies. Instead, the levels of such frequencies may simply be adjusted in order to ensure the maximum intelligibility of speech. Accordingly, in such circumstances, the low pass channel does not require any gain compression, and therefore merely contains the attenuator 10 for setting the balance or relative levels between the signals from the high pass and low pass channels supplied to the mixer 13.

Figure 5:
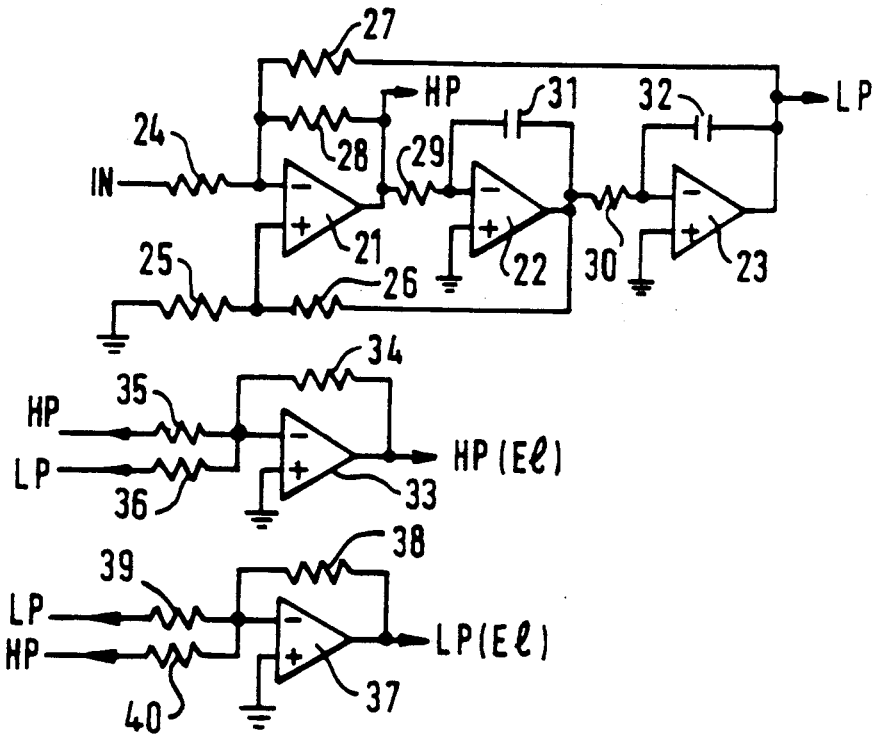
FIG. 5 is a circuit diagram of filters of the hearing aid of FIG. 4.
Figure 6:
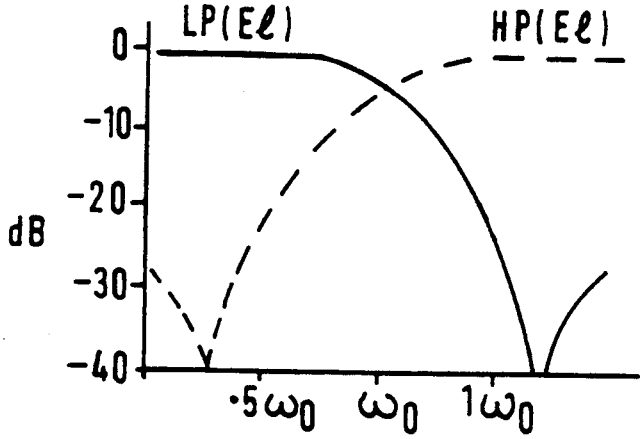
FIG. 6 is a graph showing the frequency response of the filters of FIG. 5.

FIG. 5 shows one form of filter arrangement which may be used as the high pass and low pass filters 7 and 8 in FIG. 4. This filter arrangement provides combined high pass notch and low pass notch or elliptic filter characteristics as shown in FIG. 6 at HP (E1) and LP (E1), respectively. The filter arrangement comprises a state variable filter having an input IN which receives the signal from the amplifier 2. The state variable filter includes operational amplifiers 21, 22, and 23, resistors 24 to 30, and capacitors 31 and 32, and is of conventional type. In order to provide the high pass and low pass filters 7 and 8, the high pass output HP and the low pass output LP of the state variable filter are used.

In order to provide the high pass elliptic response, the high pass and low pass outputs of the state variable filter are supplied to a mixer comprising an operational amplifier 33, negative feedback resistor 34, and input resistors 35 and 36. The value of the resistor 36 is made equal to ten times the values of the resistor 35 so that the high pass output of the state variable filter is summed with 1/10th of the low pass output to provide the output signal HP (E1) as illustrated in FIG. 6.

In order to provide the low pass elliptic characteristic, the low pass and high pass outputs of the state variable filter are supplied to a mixer comprising an operational amplifier 37, a negative feedback resistor 38, and input mixing resistors 39 and 40. The value of the resistor 40 is made ten times the value of the resistor 39 so that the low pass output of the state variable filter is summed with 1/10th of the value of the high pass output to provide the low pass elliptic output signal LP (E1) as illustrated in FIG. 6.

Figure 7:
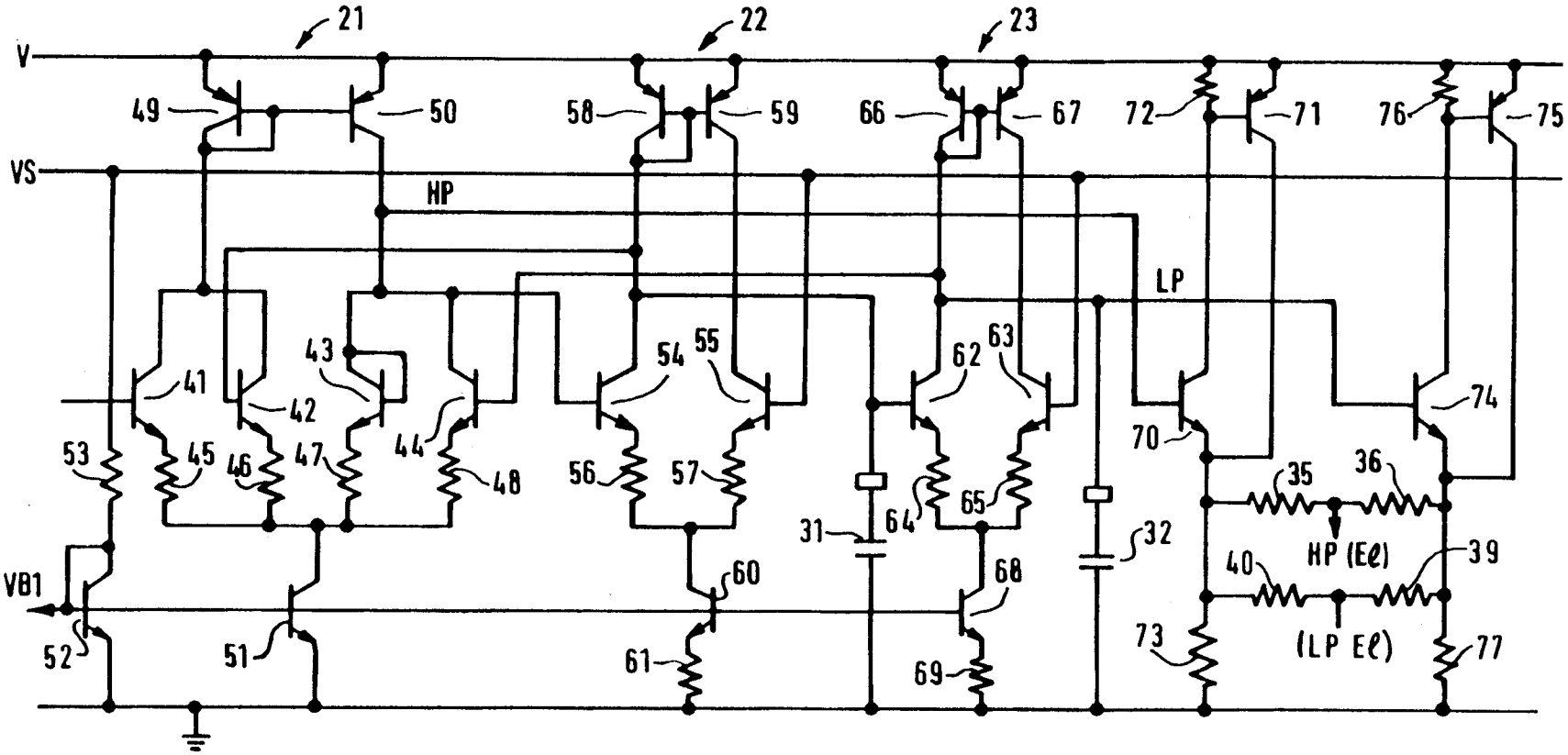
FIG. 7 is a detailed circuit diagram of a practical implementation of the filters of FIG. 5.

An advantage of this filter arrangement is that all of the components except the integrating capacitors 31 and 32 may be included on a common integrated circuit. Such an implementation of the filter arrangement is shown in FIG. 7. In FIGS. 5 and 7, the like reference numerals refer to like parts. The operational amplifier 21 comprises a differential input stage including transistors 41 to 44 and resistors 45 to 48 provided with a current mirror collector load formed by transistors 49 and 50 and a constant tail current source formed by a current mirror including a transistor 51, a transistor 52 and a current defining resistor 53. The input branch of the current mirror supplies a reference voltage VB1, and is connected between a common line and a stabilized voltage line VS derived by stabilizing means (not shown) from a supply line V.

The operational amplifier 22 is formed by a differential stage comprising transistors 54 and 55 with emitter resistors 56 and 57 and a current mirror collector load formed by transistors 58 and 59. The differential stage has a constant tail current source formed by a transistor 60 whose base is connected to receive the bias voltage VB1 and whose emitter is connected via resistor 61 to the common line. The integrating capacitor 31 is connected between the collector of the transistor 54 and the common line, and the resistor 29 is provided by the output impedance of the transistor 54.

The operational amplifier 23 is also formed by a differential pair of transistors 62 and 63 provided with emitter resistors 64 and 65, a current mirror collector load formed by transistors 66 and 67, and a constant tail current source formed by a transistor 68 and a resistor 69. The capacitor 32 is connected between the collector of the transistor 62 and the common line, and the resistor 30 is formed by the output impedance of the transistor 62.

The high pass and low pass outputs HP and LP, respectively, are connected to the inputs of combined mixing means comprising a first compound emitter follower, which is formed by transistors 70 and 71 and resistors 72 and 73, and a second compound emitter follower comprising transistors 74 and 75 and resistors 76 and 77. The resistors 35 and 36 are connected in series between the emitters of the transistors 70 and 74. Similarly, the resistors 39 and 40 are connected in series between the emitters of the transistors 70 and 74. The connection point between the resistors 35 and 36 and the connection point between the resistors 39 and 40 form the high pass and low pass outputs HP (E1) and LP (E1), respectively, of the filter arrangement.

Figure 8:
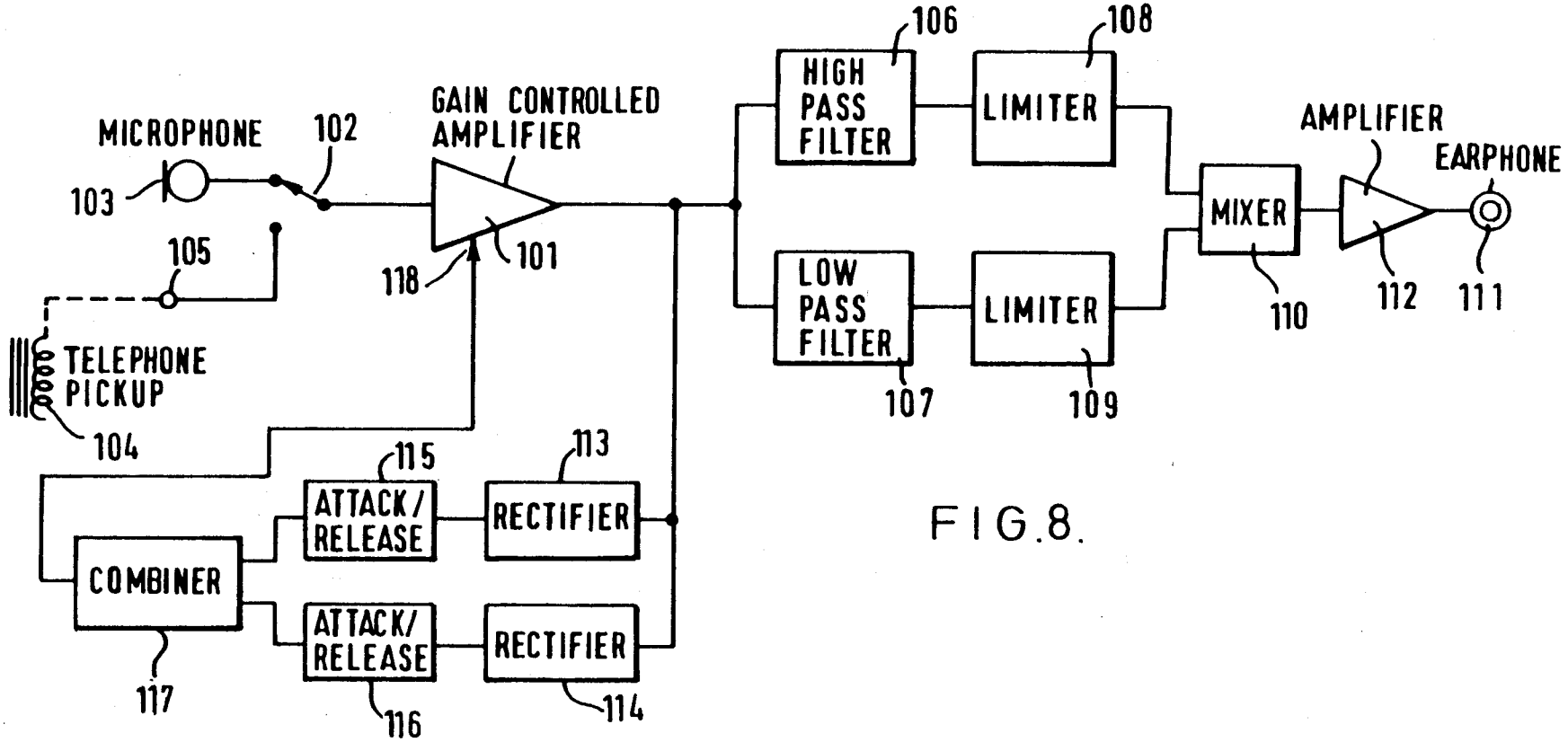
FIG. 8 is a block circuit diagram of a hearing aid constituting a second embodiment of the invention.

The hearing aid shown in FIG. 8 comprises a gain-controlled amplifier 101 whose input is connected to a changeover switch 102. The changeover switch 102 selects an input signal either from a microphone 103 forming part of the hearing aid or from a telephone pickup 104 which is optionally connected to an input terminal 105 of the hearing aid. The output of the amplifier 101 is connected to a high pass filter 106 and a low pass filter 107. The outputs of the filters 106 and 107 are connected to the inputs of dynamic range processing circuits shown as limiters 108 and 109, respectively. The outputs of the limiters 108 and 109 are supplied to a mixing circuit 110 whose output drives an earphone 111 via an amplifier 112. Adjustable attenuators may be provided to allow adjustment of the action of the limiters 108 and 109, to allow the relative levels of the signals to the mixer 110 to be adjusted, and to allow the overall volume to be set.

The output of the amplifier 101 is also connected to the inputs of rectifiers 113 and 114. The outputs of the rectifiers 113 and 114 are supplied to the inputs of attack/release circuits 115 and 116, respectively. The outputs of the circuits 115 and 116 are combined by a combiner or gate 117, which supplied a control signal to a gain control input 118 of the amplifier 101.

The attack/release circuit 115 comprises a time constant circuit having an attack time substantially equal to 75 mS and a release time substantially equal to two seconds. The attack/release circuit 116 comprises a time constant circuit having an attack time substantially equal to 2 mS and a release time substantially equal to 75 mS.

An input signal selected by the switch 102 is supplied to the amplifier 101. The rectifier 113 and circuit 115 provide a signal which corresponds to the average level of the input signal. The rectifier 114 and the circuit 116 provide a signal which corresponds to the level of peak or transient signals of relatively short duration. The combiner circuit 117 passes the signal from the circuits 115 and 116 corresponding to the lower gain of the amplifier 101. Thus, in the absence of impulsive sounds or other transient signals, the gain of the amplifier 101 is controlled by the average level of the input signal. If a transient input signal is received with a peak level which exceeds by a predetermined amount or proportion the average signal level, the gain of the amplifier 101 is reduced so as to reduce the output level of this transient signal. Once the transient has passed, the gain of the amplifier 101 is restored to the value corresponding to the output signal from the circuit 115 following the release time of the circuit 116 so as to avoid suppression of average level or relatively low level signals following the transient.

Figure 9:
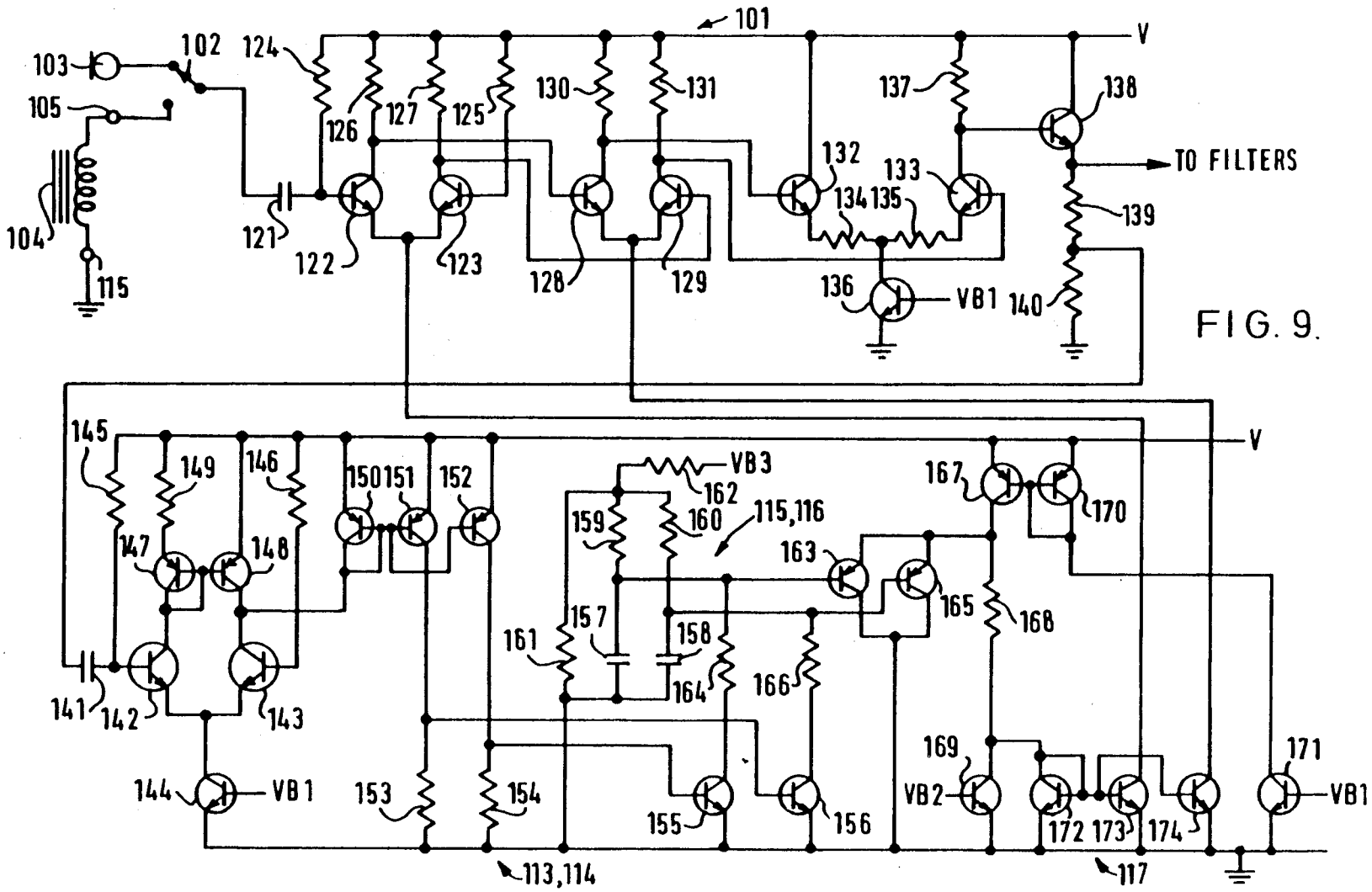
FIG. 9 is a detailed circuit diagram of part of the hearing aid of FIG. 8.

FIG. 9 shows in more detail the amplifier 101, the rectifiers 113 and 114, the attack/release circuits 115 and 116, and the combiner 117. Like reference numerals correspond to like parts. The output of the switch 102 is supplied via a coupling capacitor 121 to the base of a transistor 122 which, together with a transistor 123, forms a long-tailed pair with controlled tail current. Resistors 124 and 125 are connected between the bases of the transistors 122 and 123, respectively, and a positive supply line V to provide base bias current. The collectors of the transistors 122 and 123 are connected to the positive supply line V via collector load resistors 126 and 127, respectively, and are connected to the bases of transistors 128 and 129, respectively. The transistors 128 and 129 are connected together as a long tail pair with controlled tail current. The collectors of the transistors 128 and 129 are connected to the positive supply line V via collector load resistors 130 and 131, respectively, and to the bases of transistors 132 and 133, respectively. The emitters of the transistors 132 and 133 are connected via resistors 134 and 135, respectively, to another output branch of the current mirror comprising a transistor 136 whose base is connected to the transistor 52. The collector of the transistor 132 is connected to the positive supply line V and the collector of the transistor 133 is connected to the positive supply line via collector load resistor 137 and to the base of a transistor 138 connected as an emitter-follower with its collector connected to the positive supply line. The emitter of the transistor 138 forms the output of the amplifier 101 and is connected to the filters 106 and 107 shown in FIG. 8. The emitter is also connected via series-connected resistors 139 and 140 to the common line.

The connection between the resistors 139 and 140 is connected via a coupling capacitor 141 to the base of a transistor 142 which, together with a transistor 143, comprises a long tailed pair. The emitters of the transistors 142 and 143 are connected to a current source comprising a common emitter-connected transistor 144 whose base receives the bias voltage VB1. The bases of the transistors 142 and 143 are connected via bias resistors 145 and 146, respectively, to the positive supply line V. The collectors of the transistors 142 and 143 are connected to a current mirror formed by transistors 147 and 148 and a resistor 149 in the emitter circuit of the transistor 147. The value of the resistor 149 is selected so as to provide a current amplification ratio of 10:1 between the input current flowing through the transistor 147 and the output current flowing through the transistor 148.

The collectors of the transistors 143 and 148 are connected to the input branch of a current mirror circuit including a transistor 150. The current mirror circuit has two output branches comprising transistors 151 and 152 whose collectors are connected to the common line via resistors 153 and 154, respectively. The collectors of the transistors 151 and 152 are also connected to the bases of transistors 155 and 156, respectively, whose emitters are connected to the common line.

The attack/release circuits 115 and 116 comprise capacitors 157 and 158, respectively. The capacitors 157 and 158 are connected in series with resistors 159 and 160, respectively, the two series circuits being connected in parallel between the common line and a connection between resistors 161 and 162, whose other ends are connected to the common line and a voltage VB3 supplied by a reference voltage source (not shown), respectively.

The connection between the resistor 159 and the capacitor 157 is connected to the base of a transistor 163 and via a resistor 164 to the collector of the transistor 155. The connection between the resistor 160 and the capacitor 158 is connected to the base of a transistor 165 and via a resistor 166 to the collector of the transistor 156. The collectors of the transistors 163 and 165 are connected to the common line. The emitters of the transistors 163 and 165 are connected to the collector of a transistor 167 and to one end of a resistor 168 whose other end is connected to the collector of a transistor 169. The transistor 167 forms the output branch of a current mirror whose input branch is provided by a transistor 170. The collector and base of the transistor 170 are connected to a constant current source comprising a transistor 171 in the common emitter mode provided with the base bias voltage VB1.

The transistor 169 is connected in the common emitter mode and is provided with a base bias voltage, VB2. The collector of the transistor 169 is connected to the collector and base of a transistor 172 forming the input branch of a current mirror circuit having two output branches formed by the transistors 173 and 174. The collector of the transistor 173 is connected to the emitters of the transistors 122 and 123 so as to supply the tail current thereof. The collector of the transistor 174 is connected to the emitters of the transistors 128 and 129 so as to supply the tail current thereof.

The gain of the amplifier 101 is controlled by varying the tail currents through the transistors 122, 123 and 128, 129. A proportion of the output signal of the amplifier, determined by the values of the resistors 139 and 140, is supplied to the rectifier circuits 113 and 114 which also perform a comparison function. When the input signal is below a threshold value, the transistors 142 and 143 hold the transistors 151 and 152 off so that the transistors 155 and 156 are turned off. The capacitors 157 and 158 are therefore charged to the value of the voltage VB3, which is such as to cause the transistors 163 and 165 to pass a total of 5 microamps. The constant current source comprising the transistor 169 passes a constant current of 4 microamps. The current mirror comprising the transistors 167 and 170 reflects a current of 20 microamps supplied by the constant current source including the transistor 171. Thus, a current of 11 microamps flows through the transistor 172 forming the input branch of a current mirror. A current of 11 microamps therefore flows in the collectors of each of the transistors 173 and 174 and this forms the tail currents of the transistors 122, 123 and 128, 129, respectively. The gain of the amplifier 101 is therefore at a maximum value.

Whenever the input signal exceeds a threshold, for instance when an impulsive sound occurs, the transistors 151 and 152 are turned on. The transistors 155 and 156 are therefore also turned on and the capacitors 157 and 158 are discharged at a rate determined by the resistors 164 and 166, respectively. If the amplitude of the input signal is sufficiently high, the transistors 163 and 165 pass a total of 14 microamps, so that a current of 2 microamps flows into the transistor 172 and is reflected by the transistors 173 and 174 into the tails of the long tailed pairs comprising the transistors 122, 123 and 128, 129. The gain of the amplifier 101 is thus set to a minimum. The ratio of maximum to minimum gain of the amplifier 101 may, for instance, by approximately equal to 36 dB.

The attack and release time constants of the first gain control circuit 115 are determined principally by the values of the capacitor 157 and the resistors 159 and 164. The attack and release time constants are set to be substantially equal to 75 mS and two seconds, respectively. This may be achieved by making the capacitor 157 equal to 4.7 microfarads and by making the resistors 159 and 164 equal to 1 megohm and 22 kilohms, respectively. The second gain control circuit 116 is provided with attack and release times of 2 and 75 mS, respectively. In order to achieve this, the capacitor 158 may have a value of 0.1 microfarads and the resistors 160 and 166 may have values of 1 megohm and 22 kilohms, respectively. The resistors 164 and 166 control the attack times whereas the resistors 159 and 160 control the release times. The arrangement is such that whichever signal at the bases of the transistors 163 and 165 corresponds to minimum gain is used to control the gain of the amplifier 101.

Many of the components shown in FIG. 9, for instance all the transistors and most of the resistors, may be provided by a monolithically integrated circuit. Preferably, such a circuit is adapted to operate from a relatively low supply voltage, for instance 1.2 volts. Thus, all the electronics, the microphone 103, the earphone 111, and a battery may be accommodated within a small housing capable of being worn unobtrusively at or behind the ear of a patient.

The amplifier 101 and associated gain control components provide broadband automatic gain control between the microphone and subsequent frequency dividing and dynamic range processing parts of the hearing aid. The use of the dual AGC arrangement allows the hearing aid to accommodate signals of varying levels including transient signals corresponding to impulsive noises without overloading or causing discomfort and without suppressing quieter sounds following impulsive or transient sounds. A signal of substantially constant average level is thus supplied to the subsequent processing parts.

The filter arrangement shown in FIGS. 5–7 may be used as the filters 106 and 107 of FIG. 8. Also, the gain control arrangement of FIG. 9 may be used as the automatic gain control 2-6 of FIG. 4. The arrangement of FIGS. 5–7 and 9 may be provided in a common integrated circuit so as to reduce the space requirement and provide a compact design of the hearing aid.

We claim:

1. A hearing aid comprising:

automatic gain control means for compressing the dynamic range of an input signal by providing a reduced gain when the input signal has an amplitude exceeding a predetermined threshold so as to produce an output signal of substantially constant average signal level in response to input signal levels within a predetermined range, said automatic gain control means further comprising, first gain control means for controlling gain in response to a normal speech level component of the input signal, said first gain control means having a first release time, second gain control means for controlling gain in response to a transient or impulsive component of the input signal having a larger amplitude than said normal speech level component, said second gain control means being set to reduce gain in response to said transient or impulsive component relative to said normal speech level component without suppressing low amplitude speech signals, and said second gain control means having a second release time which is shorter than said first release time;

a plurality of signal processing channels for providing processed output signals, each of said signal processing channels receiving the output signal from said automatic gain control means and including frequency dependent filtering means; and means for providing a combined output signal from the processed output signals and for supplying the combined output signal to an electro-acoustic output transducer.

2. A hearing aid as claimed in claim 1, in which the predetermined range corresponds to a sound pressure level range between 55 and 100 dB.

3. A hearing aid as claimed in claim 1, in which said plurality of signal processing channels includes a first channel comprising a low pass filter for passing a lowest frequency range and presettable gain control means.

4. A hearing aid as claimed in claim 3, in which said plurality of signal processing channels includes at least one further signal processing channel comprising means for reducing dynamic range.

5. A hearing aid as claimed in claim 1, in which said plurality of signal processing channels comprises a state variable filter providing a high pass output for supplying a high pass signal and a low pass output for supplying a low pass signal, each of said high pass signal and low pass signals being input into first and second channels, said frequency dependent filtering means of said first channel comprising a low pass elliptic filter, and said frequency dependent filtering means of said second channel comprising a high pass elliptic filter.

6. A hearing aid as claimed in claim 5, in which said high pass elliptic filter comprises first mixing means for attenuating the low pass signals, and for mixing the high pass signal with the attenuated low pass signal, and in which said low pass elliptic filter comprises second mixing means for attenuating the high pass signal and for mixing the low pass signal with the attenuated high pass signal.

7. A hearing aid as claimed in claim 1, in which the first release time of said first gain control means is greater than 500 mS and the second release time of said second gain control means is less than 100 mS.

8. A hearing aid as claimed in claim 7, in which the first release time of said first gain control means is at least 1 second.

9. A hearing aid as claimed in claim 8, in which the first release time of said first gain control means is at least 2 seconds.

10. A hearing aid as claimed in claim 9, in which the first release time of said first gain control means is substantially equal to 5 seconds.

11. A hearing aid as claimed claim 7, in which the second release time of said second gain control means is less than 75 mS.

12. A hearing aid as claimed in claim 11, in which the second release time of said second gain control means is substantially equal to 50 mS.

13. A hearing aid as claimed in claim 11, in which said first gain control means has a first attack time of less than 100 mS.

14. A hearing aid as claimed in claim 13, in which the first attack time of said first gain control means is not greater than or equal to 50 mS.

15. A hearing aid as claimed claim 11, in which said second gain control means has a second attack time of less than 10 mS.

16. A hearing aid as claimed in claim 15, in which the second attack time of said second gain control means is substantially equal to 2 mS.

17. A hearing aid as claimed in claim 1, in which said first gain control means has an attack time substantially equal to the second release time of said second gain control means.

18. A hearing aid as claimed in claim 1, in which said automatic gain control means includes a single variable gain element controlled by said first and second gain control means.

19. A hearing aid as claimed in claim 18, in which said automatic gain control means includes gate means for controlling said variable gain element to respond to the one of said first and second gain control means signalling lower gain.

20. A hearing aid as claimed in claim 19, in which said first gain control means responds to input signal levels above a first threshold and said second gain control means responds to input signal levels above a second threshold, the first threshold being lower than the second threshold.

21. A hearing aid comprising:

automatic gain control means for compressing the dynamic range of an input signal by providing a reduced gain when the input signal has an amplitude exceeding a predetermined threshold and for producing an output signal of substantially constant average signal level in response to input signal levels within a predetermined range, said automatic gain control means comprising first and second gain control means for controlling gain response to the input signal, said first gain control means operating to control gain in response to normal speech levels by responding to signal levels above a first amplitude threshold, said second gain control means operating to control gain in response to transient or impulsive signals of large amplitude without suppressing low amplitude speech signals by responding to signal levels above a second amplitude threshold, the first threshold being lower than the second threshold, said first gain control means having a first release time and said second gain control means having a second release time, the first release time being longer than the second release time;

a plurality of signal processing channels for providing processed output signals, each of said signal processing channels receiving the output signal from said automatic gain control means and including frequency dependent filtering means; and means for providing a combined output signal from the processed output signals and for supplying the combined output signal to an electro-acoustic output transducer.

* * * * *